US008313627B2

(12) United States Patent
Gerharz et al.

(10) Patent No.: US 8,313,627 B2
(45) Date of Patent: Nov. 20, 2012

(54) DRAG THROUGH ELECTRO-DEPOSITION SYSTEM

(75) Inventors: Rainer Gerharz, Troy, MI (US); Russell A. Wiedmaier, Novi, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1335 days.

(21) Appl. No.: 12/018,877

(22) Filed: Jan. 24, 2008

(65) Prior Publication Data

US 2009/0188797 A1 Jul. 30, 2009

(51) Int. Cl.
*C25B 15/02* (2006.01)
*C25B 9/12* (2006.01)

(52) U.S. Cl. ..... 204/472; 204/471; 204/198; 204/625

(58) Field of Classification Search ..... 204/471, 204/472, 481, 198, 622, 625, 626; 205/188
See application file for complete search history.

(56) References Cited

U.S. PATENT DOCUMENTS

| | | | | |
|---|---|---|---|---|
| 5,441,619 | A * | 8/1995 | Kawachi et al. | 204/206 |
| 2004/0245093 | A1 | 12/2004 | Hubel | |
| 2008/0271993 | A1 | 11/2008 | Noller | |

FOREIGN PATENT DOCUMENTS

| | | | |
|---|---|---|---|
| CN | 2402691 | Y | 10/2000 |
| DE | 19942556 | C2 | 3/2001 |
| DE | 10326605 | A1 | 1/2005 |
| WO | WO 2007/017153 | * | 2/2007 |

* cited by examiner

*Primary Examiner* — Vickie Kim
*Assistant Examiner* — Dwan A Gerido

(57) ABSTRACT

A drag through electro-deposition system and a method of performing a drag through electro-deposition process on a vehicle body is disclosed. The system may include pairs of anodes, with each pair having a corresponding anode pair power supply. As a vehicle body is carried through the electro-deposition tank, the electric power to each pair is individually adjusted relative to the vehicle body position in the tank.

1 Claim, 3 Drawing Sheets

DRAG THROUGH ELECTRO-DEPOSITION SYSTEM

BACKGROUND OF INVENTION

The present invention relates generally to electro-deposition (electroplating) systems for applying a coating to an assembly, and more particularly to an electro-deposition system that employs a drag through electrolyte bath.

It is common practice to coat vehicle bodies with an anti-corrosion coating by employing an electro-deposition process. A type of system employed for high volume vehicle production is a drag through type of electro-deposition assembly. Conventional drag through electro-deposition assemblies include an electrolyte bath through which the vehicle bodies are dragged as they are undergoing the electro-deposition process. In these conventional assemblies, typically only two or three large rectifiers are employed, with each supplying very high current to a relatively large number of anodes located in the tank. As such, they are generally custom built rectifier/anode assemblies that have relatively limited process controllability and only voltage control. Accordingly, the costs for such systems, as well as the cost of rectifier backup for these systems is more expensive than is desired. Moreover, they do not lend themselves to adjusting the system to accommodate increases in vehicle production.

Another type of electro-deposition system for vehicle bodies employs an index tank. In an index tank the vehicle body is dropped straight down into the tank, the electro-deposition takes place, and then the vehicle is lifted straight up out of the tank. One type of index tank system uses multiple pairs of anodes, with each pair of anodes powered by a direct current source. While the particular vehicle body is stationary in the index tank, a constant current is applied to each pair of anodes to cause the desired amount of corrosion protection to be applied to the various parts of the vehicle body. While eliminating the small number of high power rectifiers that are employed with drag through tanks, index tanks are not practical for high volume production of vehicles—the throughput capability of each index tank is generally too low.

SUMMARY OF INVENTION

An embodiment contemplates a drag through electro-deposition system for electroplating a vehicle body. The system my comprise a drag through electro-deposition tank containing an electrolyte solution, a vehicle body carrier configured to support and carry the vehicle body through the drag through electro-deposition tank, and a position monitor configured to monitor a position of the vehicle body as the vehicle body is dragged through the drag through electro-deposition tank. The system may also include a plurality of pairs of anodes located in the drag through electro-deposition tank, a plurality of anode pair power supplies, each of the anode pair power supplies configured to provide electrical power to at most two of the pairs of anodes, and a control system operatively engaging the plurality of anode pair power supplies and configured to individually control each of the anode pair power supplies to adjust the electrical power provided to the plurality of pairs of anodes based on a location of the vehicle body as the vehicle body is dragged through the drag through electro-deposition tank.

An embodiment contemplates a method of performing a drag through electro-deposition process on a vehicle body, the method comprising the steps of: moving the vehicle body through a drag through electro-deposition tank; monitoring vehicle body locations as the vehicle body moves through the drag through electro-deposition tank; determining a voltage and current to be applied to each pair of a plurality of pairs of anodes located in the drag through electro-deposition tank for a current position of the vehicle body in the drag through electro-deposition tank; applying the determined voltage and current for each of the pairs of anodes, via a corresponding one of a plurality of anode pair power supplies, to the respective pairs of anodes; and repeating these steps until the drag through electro-deposition process is complete.

An embodiment contemplates a method of performing a drag through electro-deposition process on a vehicle body, the method comprising the steps of: moving the vehicle body through a drag through electro-deposition tank; determining a current location of the vehicle body in the drag through electro-deposition tank; determining a voltage and current to be applied to a first pair of anodes located in the drag through electro-deposition tank for the current location of the vehicle body in the drag though electro-deposition tank; applying the determined voltage and current for the first pair of anodes via a first anode pair power supply; determining a voltage and current to be applied to a second pair of anodes located in the drag through electro-deposition tank for the current location of the vehicle body in the drag though electro-deposition tank; applying the determined voltage and current for the second pair of anodes via a second anode pair power supply; determining a voltage and current to be applied to an $n^{th}$ pair of anodes located in the drag through electro-deposition tank for the current location of the vehicle body in the drag though electro-deposition tank; applying the determined voltage and current for the $n^{th}$ pair of anodes via an $n^{th}$ anode pair power supply; and repeating these steps until the drag through electro-deposition process is complete.

An advantage of an embodiment is that adjustments in power to individual anode pairs is accomplished to provide for the desired coating of a vehicle body, while still allowing for high volume production use of a drag through electro-deposition tank. The powering of individual pairs of anodes may extend the lifetime of the anodes as compared to conventional high current rectifier arrangements where a single rectifier powers a high number of anodes. Also, since power to individual pairs of anodes is controlled, the more modular system that results can be more easily adjusted for production increases or decreases by adding or subtracting power modules in the system. Moreover, with a high number of modules, the loss of one or two modules (e.g., due to malfunctions) does not adversely affect the coating quality—thus, expensive backups are not required as was the case with some prior art systems. This also allows for adjustments to account for the different materials that vehicle bodies may be made of.

DETAILED DESCRIPTION

Figure 1:
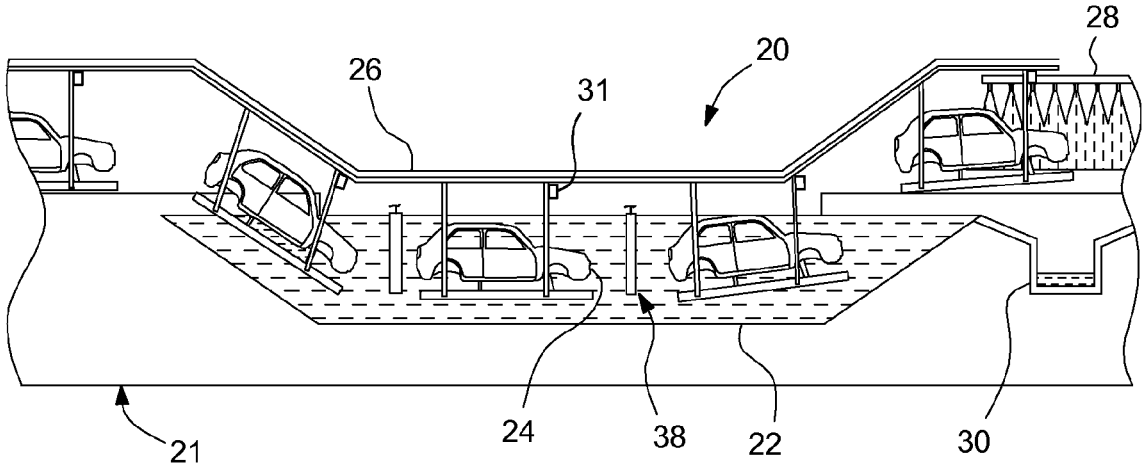
FIG. 1 is a schematic illustration of a portion of a drag through electroplating system with vehicle bodies undergoing an electro-deposition process.
Figure 2:
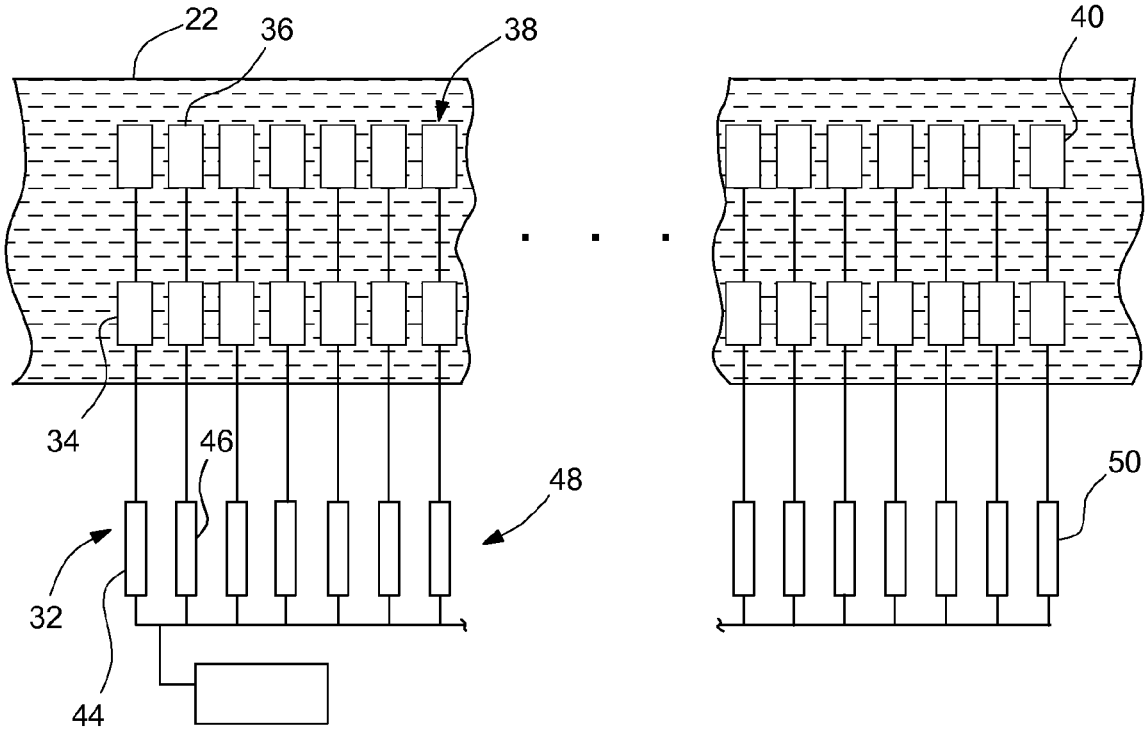
FIG. 2 is a schematic illustration of a portion of the drag through electroplating system.
Figure 3:
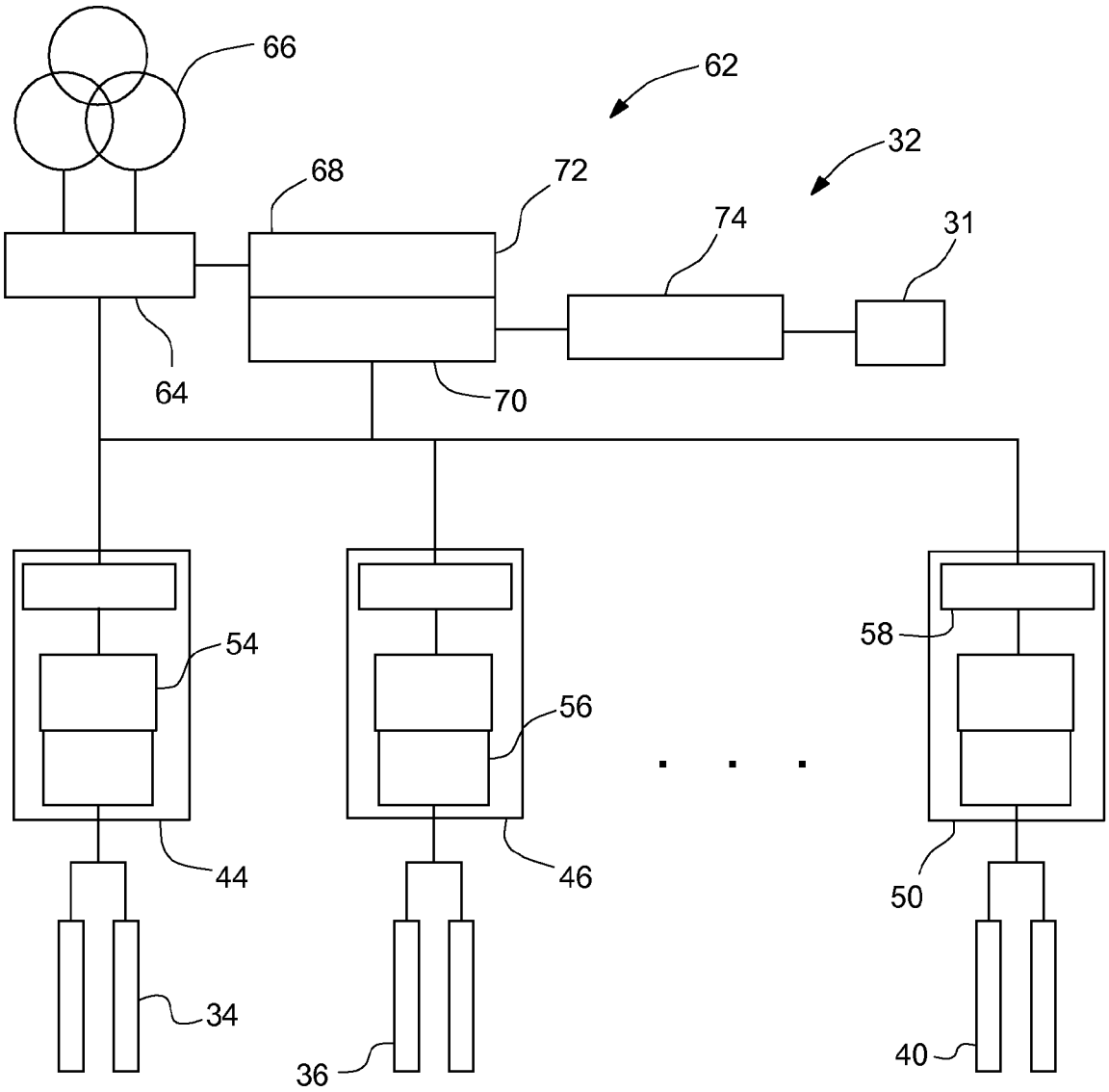
FIG. 3 is a schematic illustration of an electronics and control system of the drag through electroplating system.

Referring to FIGS. 1-3, a drag through electro-deposition system, indicated generally at 20, is shown in a vehicle production plant 21. This system 20 includes an electro-deposition tank 22 holding an electrolyte solution through which vehicle bodies 24 are dragged. A conveyor 26 supports the vehicle bodies 24 as they are lowered down and dragged through the tank 22 (from left to right as seen in FIG. 1). The conveyor 26 may also move the vehicle bodies 24 through a post electro-deposition rinse assembly 28, located above a catch basin 30 for the rinse. One will note that multiple vehicle bodies 24 can be in the electrolyte bath at the same time undergoing the electro-deposition process. The position of each vehicle body 24 in the tank 22 may be determined by position sensors 31 traveling with the vehicle bodies 24. Other means for tracking the position of the vehicle bodies 24 as they are dragged through the tank 22 may be used instead, if so desired.

In the electro-deposition process, the vehicle bodies 24 act as the cathodes as they travel through the tank 22, while stationary anodes are located in the tank 22, thus being an anodic system. The anodes are part of an electronics and control system 32 that supplies the electricity for causing the electro-deposition process. Alternatively, a cathodic system may be employed instead, in which case, the anodes discussed herein would be cathodes. Thus, when referring to anodes herein, the term applies to cathodes when employing a cathodic system rather than an anodic system.

A first pair of anodes 34 are located in the tank 22 and encounter a vehicle body 24 first as it starts its travel through the tank 22. A second pair of anodes 36 are located adjacent to and encounter the vehicle body 24 after the first pair of anodes 34. There may be any number of other pairs of anodes, referred to generally at 38, up to an $n^{th}$ pair of anodes 40. The $n^{th}$ pair of anodes 40 are the last pair of anodes exposed to the vehicle body 24 before it leaves the tank 22. The tank 22 may, for example, contain ten to thirty pairs of anodes 38, with the number of pairs variable to accommodate the particular application (only two anode pairs shown in FIG. 1 for clarity in showing other parts of the system).

The electronics and control system 32 also includes a first anode pair power supply 44, a second anode pair power supply 46, a number of other anode pair power supplies, referred to generally at 48, and an $n^{th}$ anode pair power supply 50. The first anode pair power supply 44 supplies the electrical power to the first pair of anodes 34, the second anode pair power supply 46 supplies the electrical power to the second pair of anodes 36, and the $n^{th}$ anode pair power supply 50 supplies power to the $n^{th}$ pair of anodes 40. Thus, each pair of anodes has its own power supply, allowing for modularity of the system 22. Due to the modularity of the system, each anode power supply may be the same as all of the other anode pair power supplies.

Each anode pair power supply 44, 46, 48, 50 may include a direct current source 54, a compensation filter and diodes 56, and an isolation transformer 58. With this arrangement, then, the current and voltage for each pair of anodes 34, 36, 38, 40, can be individually adjusted. That is, a particular pair of anodes can be operating at a different current or voltage than the other pairs of anodes in the electronics and control system 32.

The electronics and control system 32 also includes a control portion 62 that controls each of the anode pair power supplies 44, 46, 48, 50. The control portion 62 may include a power control unit 64 connected to a transformer 66 and another control unit 68 that may include data recording 70 and safety monitoring 72 subsystems. A control panel 74 may interact with the control unit 68 and provide an interface for technicians to input desired parameters into the system 32, as well as receiving a position indication from the sensors 31.

Figure 4:
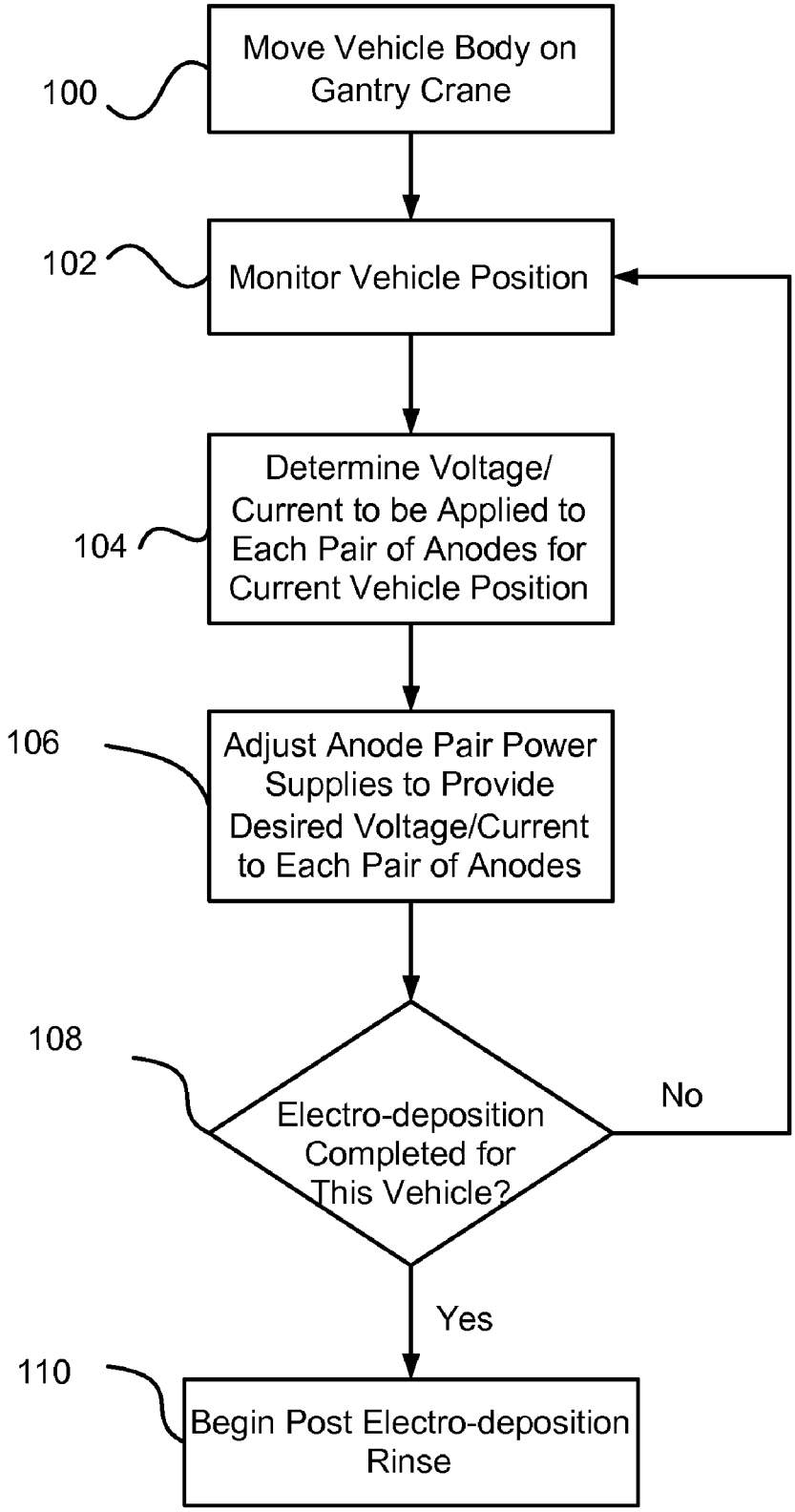
FIG. 4 is a flow chart illustrating a method of electro-deposition employing the drag through electro-deposition system of FIGS. 1-3.

FIG. 4 is a flow chart illustrating a method of electro-deposition employing the drag through electro-deposition system 20 of FIGS. 1-3. While this discussion is directed toward one vehicle body 24 moving through the drag through electro-deposition system 20, multiple vehicle bodies 24, of course, will be undergoing different portions of the process simultaneously. This is an advantage of employing a drag through tank 22—maximizing the number of vehicle bodies 24 per hour that can be processed.

The vehicle body 24 is moved by the conveyer 26 into the electro-deposition tank 22, block 100. As the vehicle body 24 is moved into the tank 22, the vehicle position is monitored, block 102. A voltage and current to be applied for each pair of anodes 34, 36, 38, 40, based on the vehicle position, is determined, block 104. Each pair of anodes may have a different voltage/current determination based on the current position of the vehicle body (i.e., what portion of the vehicle body 24 is currently between a particular pair of anodes) and the position the particular pair of anodes is in the electro-deposition process (relative to the other anode pairs) in order to achieve the desired coating of the vehicle body 24. Each anode pair power supply 44, 46, 48, 50 is adjusted to provide the desired voltage/current to each pair of anodes 34, 36, 38, 40, block 106. For some anode pairs, then, it may be that little or no voltage/current is provided if the vehicle body position is such that it is not currently between that particular pair of anodes. If the electro-deposition process for that vehicle body 24 is not complete, block 108, then the steps in blocks 102-106 are repeated until complete. After the electro-deposition process is complete, then the vehicle body 24 may proceed being carried through a post electro-deposition rinse, block 110.

Of course, since this is a drag through electro-deposition tank 22, while the $n^{th}$ pair of anodes 40 is provided with a current/voltage for the portion of the present vehicle body 24 that is between them, the first pair of anodes 34 may have a current/voltage setting that is adjusted to provide the desired electro-deposition to a portion of the next vehicle body being dragged through the tank 22 that is located between that particular pair. In this way, the number of vehicle bodies 24 being treated can be maximized. This also allows for adjustment of the voltages/currents in the anode pairs to account for vehicle bodies of different lengths and shapes being dragged through the tank 22, if so desired. Moreover, voltages/currents can be individually adjusted in the anode pairs to account for vehicle bodes 24 made of different materials being dragged through the tank 22.

As a alternative, two pair of anodes may be supplied by each individual power supply, which still allows for selective coating of the vehicle body as it is dragged through the tank-even though there is somewhat less fine tuning of the voltages/currents for the electro-deposition process.

While certain embodiments of the present invention have been described in detail, those familiar with the art to which this invention relates will recognize various alternative designs and embodiments for practicing the invention as defined by the following claims.

What is claimed is:

1. A method of performing a drag through electro-deposition process on a vehicle body, the method comprising the steps of:

(a) moving the vehicle body through a drag through electro-deposition tank;

(b) determining a current location of the vehicle body in the drag through electro-deposition tank;

(c) determining a first non-zero electrical power to be applied to a first pair of anodes located in the drag through electro-deposition tank for the current location of the vehicle body in the drag though electro-deposition tank;

(d) applying the determined first electrical power for the first pair of anodes via a first anode pair power supply;

(e) determining a second non-zero electrical power to be applied to a second pair of anodes located in the drag through electro-deposition tank for the current location of the vehicle body in the drag though electro-deposition tank, the second electrical power being different from the first electrical power;

(f) applying the determined second electrical power for the second pair of anodes via a second anode pair power supply;

(g) determining an $n^{th}$ non-zero electrical power to be applied to an $n^{th}$ pair of anodes located in the drag through electro-deposition tank for the current location of the vehicle body in the drag though electro-deposition tank, the $n^{th}$ electrical power being different from the first and second electrical power;

(h) applying the determined $n^{th}$ electrical power for the $n^{th}$ pair of anodes via an $n^{th}$ anode pair power supply; and (e) repeating steps (b)-(h) until the drag through electro-deposition process is complete.

* * * * *